United States Patent [19]

Delgado

[11] 4,221,055

[45] Sep. 9, 1980

[54] DRAFTING INSTRUMENT

[76] Inventor: Randy D. Delgado, 3209 Meyer, Saginaw, Mich. 48603

[21] Appl. No.: 967,297

[22] Filed: Dec. 7, 1978

[51] Int. Cl.[3] ..... B43L 13/00

[52] U.S. Cl. ..... 33/418; 33/424

[58] Field of Search ..... 33/403, 467, 452, 456, 33/477, 418, 422, 459, 460, 461, 462, 424, 425, 426

[56] References Cited

U.S. PATENT DOCUMENTS

| | | | |
|---|---|---|---|
| 1,378,745 | 5/1921 | Wavrin | 33/460 |
| 2,042,885 | 6/1936 | Fay | 33/418 |
| 2,345,477 | 3/1944 | Hull | 33/418 |
| 2,501,521 | 3/1950 | Howard | 33/418 |
| 2,515,761 | 7/1950 | DeJuhasz | 33/422 |
| 2,887,775 | 5/1959 | Ross | 33/459 |
| 3,266,156 | 8/1966 | Debs | 33/424 |

FOREIGN PATENT DOCUMENTS

| | | | |
|---|---|---|---|
| 663970 | 1/1952 | United Kingdom | 33/418 |

*Primary Examiner*—John W. Shepperd
*Attorney, Agent, or Firm*—John J. Swartz

[57] ABSTRACT

A drafting instrument comprising a central plate member, and first and second drafting plates, each including two sides having first and second angularly related straight edges forming an angle therebetween and a third hypotenuse edge spanning the first and second edges, and mechanism pivotally coupling the first and second plates to the central plate member for swinging movement relative thereto and relative to each other.

15 Claims, 10 Drawing Figures

DRAFTING INSTRUMENT

BACKGROUND OF THE INVENTION

This invention relates to a drafting instrument and more particularly to a drafting instrument including a pair of generally triangular shaped drafting plates coupled to opposite sides of a central mounting member for swinging movement between any one of a plurality of different, spaced apart positions so that a straight edge is presented in any one of a plurality of different positions.

Drafting instruments have been provided heretofore which include a relatively adjustable triangularly shaped section. Drafting instruments of the type described herein are conventionally utilized by a draftsman in connection with a drafting table including a parallel bar or T-square which extends parallel to the upper and lower edges of an upwardly inclined drafting table. The T-square or parallel bar has upper and lower parallel edges against which a drafting instrument can be placed. A draftsman will preferably place the drafting instrument against the upper edge of the T-square or parallel bar. With conventional drafting instruments, it is sometimes necessary that the draftsman work from the lower edge of the T-square or parallel bar. The placement of the drafting instrument against the lower edge of the parallel bar is awkward and time consuming.

Draftsman frequently refer to angles between 0° and 90°, 90° to 180°, 180° to 270°, and 270° to 360°, as being in the first, second, third, and fourth quadrants, respectively.

As an aid to uniform lettering, a draftsman will frequently place a lettering set against the drafting instrument which in turn is placed against the parallel bar. The prior art drafting instruments are particularly limited when inverted lettering, as viewed from the bottom of the drafting paper, is to be accomplished at obtuse angles in the second quadrant.

Accordingly, it is an object of the present invention to provide a new and novel drafting instrument.

Another object of the present invention is to provide a new and novel drafting instrument which will permit greater flexibility to a draftsman drawing lines at various angles.

A further object of the present invention is to provide a new and novel time saving drafting instrument.

A still further object of the present invention is to provide a new and novel drafting instrument which can be adjusted to any one of a plurality of positions in any quadrant.

Another object of the present invention is to provide a new and novel drafting instrument which can be mounted against the upper edge of a drafting table parallel bar and provides a straight edge in the second quadrant in confronting relation to the upper edge of the parallel bar.

Another object of the present invention is to provide a drafting instrument which, when mounted on the upper edge of a drafting table parallel bar, will present a lettering edge in the second quadrant against which a lettering set may be mounted so that inverted letters may be printed in the second quadrant on the drafting paper.

Yet another object of the present invention is to provide a new and novel drafting instrument including a pair of generally triangularly shaped members coupled to a central mounting member for swinging movement between any one of a plurality of different positions.

Still another object of the present invention is to provide a new and novel drafting instrument including a pair of similarly constructed, generally triangularly shaped templates mounted on laterally opposite sides of a central member for movement between any one of a plurality of different spaced apart positions in which corresponding edges are disposed in parallel relation at any one of a plurality of differing spaced apart locations.

Another object of the present invention is to provide a new and novel drafting instrument including a pair of similarly constructed drafting templates each including a triangularly shaped section and a truncated triangle section, and a central planar coupling member mounting the templates on laterally opposite sides thereof for swinging movement between any selected one of a plurality of different positions.

A further object of the present invention is to provide a new and novel drafting instrument including a pair of identical, generally triangularly shaped drafting plates, each including first and second right angularly related edges, and mechanism mounting the plates for relative swinging movement between positions in which the second edge of one of the members is movable between a position in which the included angle between the first edge of one of said members and the second edge of the other of said members is variable between acute and obtuse angles.

A still further object of the present invention is to provide a new and novel drafting instrument of the type described including protractor mechanism for measuring the angular relationship between the straight edge portions of the pivotally connected drafting plates.

Another object of the present invention is to provide a drafting instrument including a central mounting member having generally parallel end edges and a pair of generally triangularly shaped drafting plates each including a truncated triangle section, and mechanism mounting the drafting plates for movement relative to the central mounting member between positions in which the truncated edges of the triangularly shaped sections lie in the planes of the end edges of the central mounting means and angularly related positions.

These and other objects of the present invention will become more readily apparent as the description thereof proceeds.

SUMMARY OF THE INVENTION

A drafting instrument including first and second, generally planar, generally triangularly shaped, drafting plates, each including first and second angularly related side edges spanned by a hypotenus edge, and coupling mechanism coupling the plates for swinging movement between any one of a plurality of different spaced apart positions in which the corresponding edges of the first and second plates are parallel, as well as for swinging movement between a position in which the second edge of one of the plates is at an obtuse angle relative to the first edge of the other of said plates.

The present invention may more readily be understood by reference to the accompanying drawings in which.

DESCRIPTION OF THE PREFERRED EMBODIMENT

Figure 10:
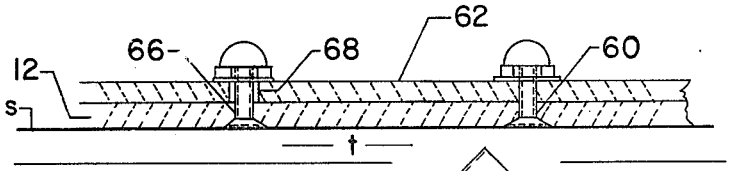
FIG. 10 is an end elevational view, taken along the line 10—10 of FIG. 1.

A drafting instrument constructed according to the present invention is generally designated 10, and includes a pair of identical, generally triangularly shaped drafting plates or templates 12 and 12*a*. The plates or templates 12 may suitably comprise translucent plexiglass. The triangularly shaped drafting plates 12 and 12*a* are identical, thus, only the drafting plate 12 will be described. Corresponding parts of the drafting plate 12*a* will be identified by identical numerals followed by the letter a subscript. The drafting instrument 10 is particularly adapted for use with a drafting tablet t (FIG. 10) mounting a T-square or parallel bar T having an edge e against which the instrument 10 is placed. A sheet s of drafting paper is supported by the table t in the usual fashion. The table t includes generally parallel top and bottom end edges spanned by generally parallel side edges. The T-bar or parallel bar T spans the side edges and is mounted for to-and-fro movement between any one of a plurality of different positions in which the edge e remains parallel to the top and bottom end edges, as usual.

Figure 9:
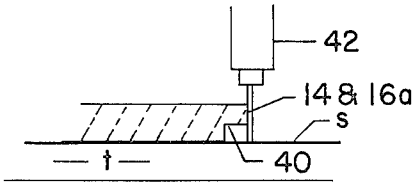
FIG. 9 is an enlarged sectional side view, taken along the line 9—9 of FIG. 1.

The drafting plate 12 includes first and second right angularly related straight edges 14 and 16 joined at an apex 18. The distal or terminal ends 20 and 22 of the edges 14 and 16 are joined by a third hypotenuse edge, generally designated 24, including angularly related straight edge portions 26 and 28 which converge in a direction toward the apex 18 and intersect at 29. The straight edge portion 28 and straight edge portion 16 are spanned by a linear, terminal edge portion 30. A vertical plane 32 intersecting the apex 18 and the junction 29 defines a triangularly shaped section, generally designated 36, and a truncated triangle 37. As illustrated in FIG. 9, the lower portions of the linear edges 14 and 16*a* are notched, as illustrated at 40, to provide an inking edge recess which permits ink applied to paper sheet s by an inking pen 42 to spread inwardly toward the edge 14 without striking the edge 14.

The drafting instrument 10 also includes a central, generally planar mounting member, generally designated 44, including laterally opposite edges 46 and 48, each including a central edge section 50, parallel to the laterally opposite central edge 50, and laterally outwardly converging, linear edge portions 52 and 54 which are generally parallel to the opposite linear edges 52 and 54 respectively. The mounting member 44 includes generally linear end edges 56 spanning the terminal ends of the laterally opposite edge portions 52 and 54. The central edge portion 50 and end edge portion 54 are complementally shaped to the hypotenuse edge portions 28 and 26 respectively, of the triangles 12 and 12*a*. It should further be noted that in the position of the parts illustrated in FIG. 1, the truncated edges 30 lie in the planes of the end edge 56.

The triangle sections 12 and 12*a* are pivotally mounted on the central mounting 44 via pivot pins 60 which permits relative swinging movement of the triangles relative to the base member 44 and relative to each other between any one of a plurality of different positions as illustrated for example, in FIGS. 3-8.

A pair of generally planar protractors 62, are cantileverly mounted on the upper surface of mounting member 44 along the central edge portions 50. The plates 12 and 12*a* are pivotally mounted on the underside of the protractors 62 via pivot pins 60 for movement in the plane of central mounting member 44, between any one of a plurality of positions, such, for example, as those positions illustrated in FIGS. 3-8. The templates 12 and 12*a* include guide pins 66 slidably received in arcuate guide slots 68 cut through the template 62 for guiding the swinging movement of the templates 12 and 12*a*. The protractors 62 each includes an annular scale 69 for measuring the relative angular positions of the edges 14, 16, and 14*a* and 16*a*.

THE OPERATION

Figure 1:
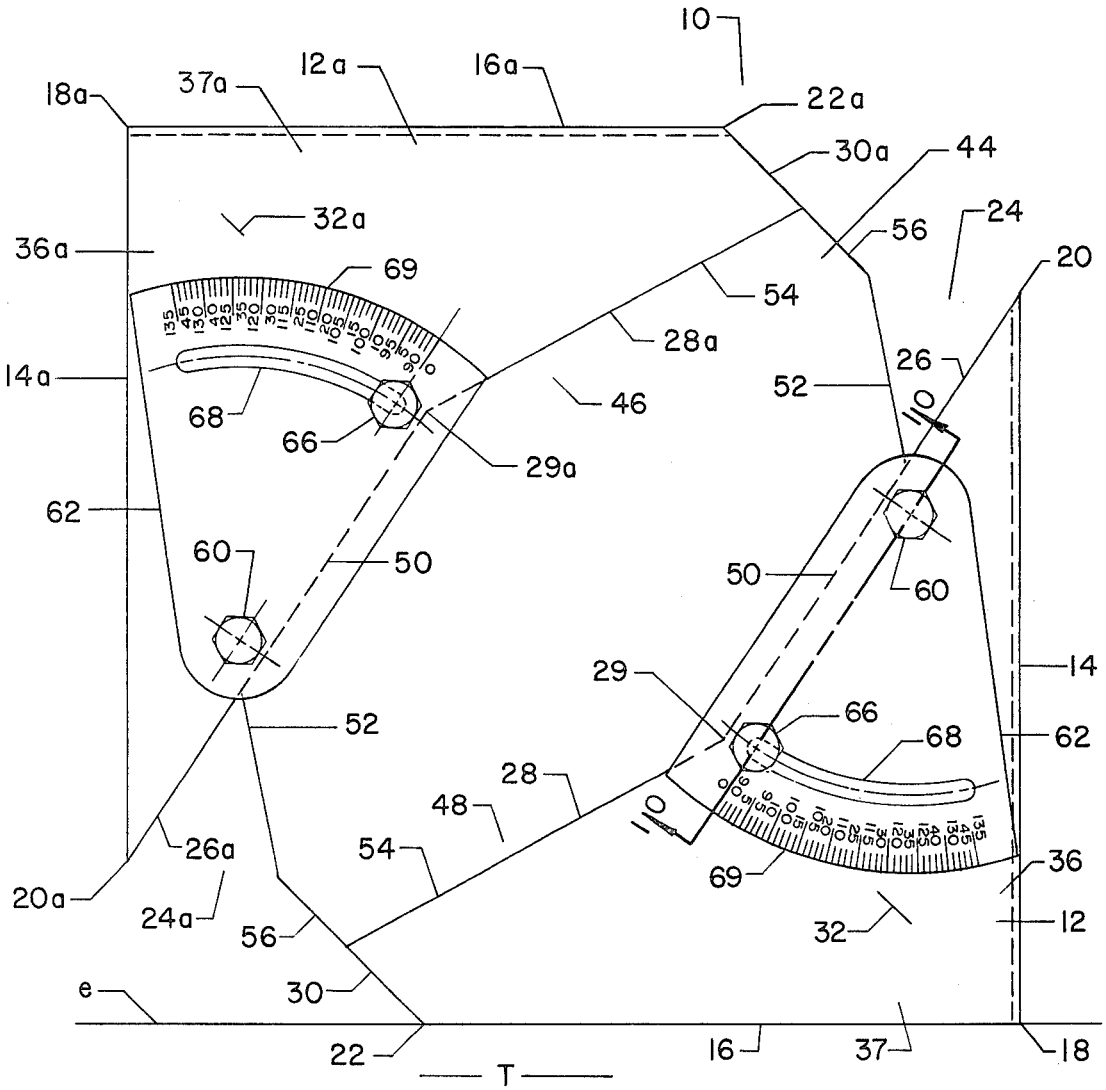
FIG. 1 is a top plan view of apparatus constructed according to the present invention.
Figure 2:
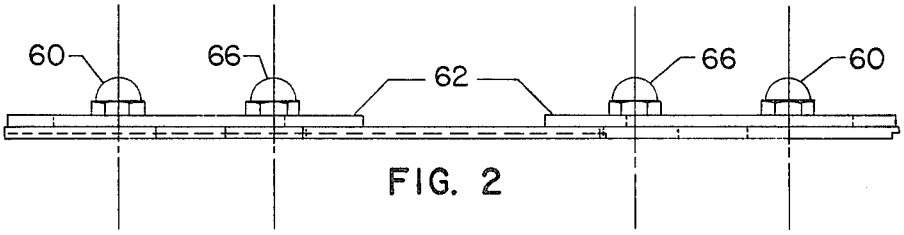
FIG. 2 is a side elevational view thereof.
Figure 3:
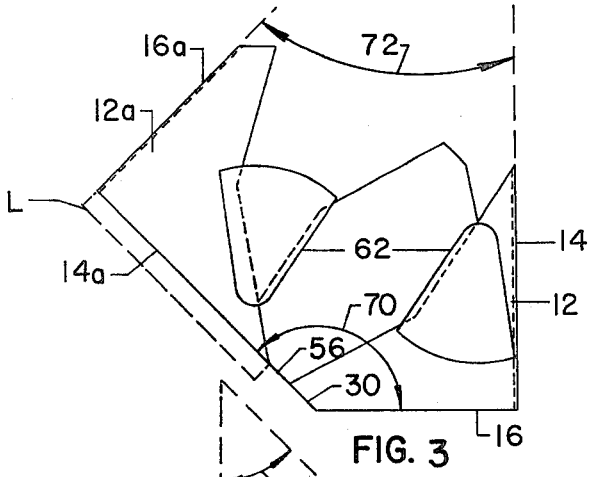
FIGS. 3-8 illustrate the various parts in a plurality of adjusted positions.

In operation, the draftsman might initially position the edge 16 of plate 12 along the upper edge e of the T-square T mounted on the drafting table t. In the position of the parts as illustrated in FIG. 1, the edges 14*a* and 14 are parallel and the edges 16 and 16*a* are also parallel. The draftsman may then move the template 12*a* relative to the central mounting member 44 to the position illustrated in FIG. 3 in which the included angle 70 between the edge 16 of template 12 and the edge 14*a* of template 12*a* is an obtuse angle and the included angle 72 between the edge 16*a* of template 12*a* and the edge 14 of template 12 is an acute angle. It should be noted that when the parts are positioned as illustrated in FIG. 3, the linear edge 14*a* of template 12*a* confronts the edge e of T-bar T and lies in the plane of the edges 30 and 56 of template 12. In the position of the parts illustrated in FIG. 3, a draftsman can place a lettering set, schematically designated L, along the edge 14*a* so as to draw inverted letters which can be read from the upper edge of the drafting paper. On the other hand, the draftsman could invert the lettering set L so that the letters drawn with lettering set L are readable from the bottom of the page.

Figure 4:
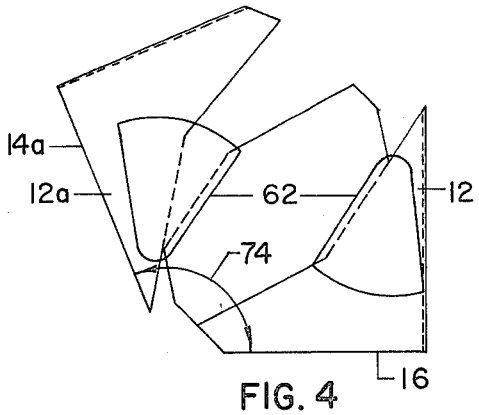

When the parts are moved to the positions illustrated in FIG. 4, the included angle, indicated by the reference character 74, between the edge 16 of template 12 and edge 14*a* of template 12*a* is a different obtuse angle.

Figure 7:
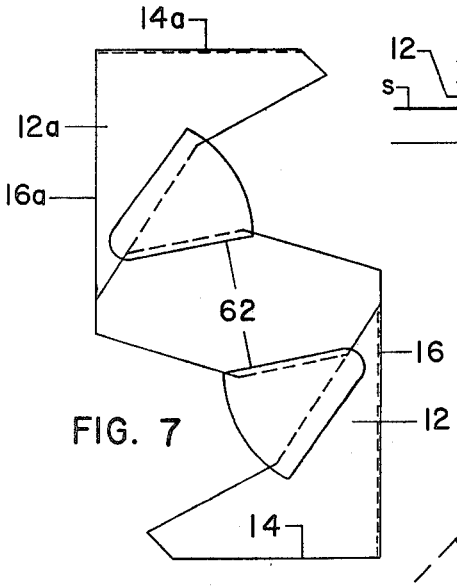

Referring now to FIG. 7, the templates 12 and 12*a* can be adjusted to substantially spaced apart positions relative to their positions illustrated in FIG. 1, but yet the corresponding sides 14 and 14*a* remain parallel and the corresponding sides 16 and 16*a* remain parallel.

Figure 8:
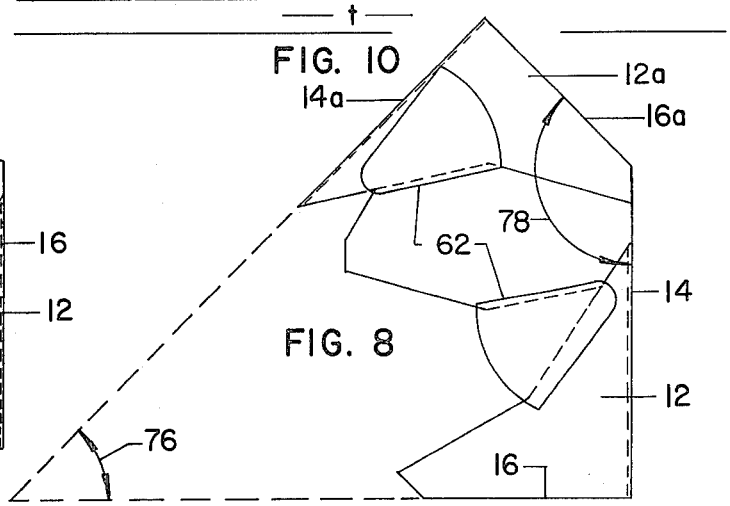

When the parts are moved to the positions illustrated in FIG. 8, the included angle 76 between the edge 14*a* of template 12*a* and edge 16 of template 12 is an acute angle, whereas the angle 78 between the edges 16*a* of template 12*a* and the edge 14 of template 12 is an obtuse angle.

Figure 5:
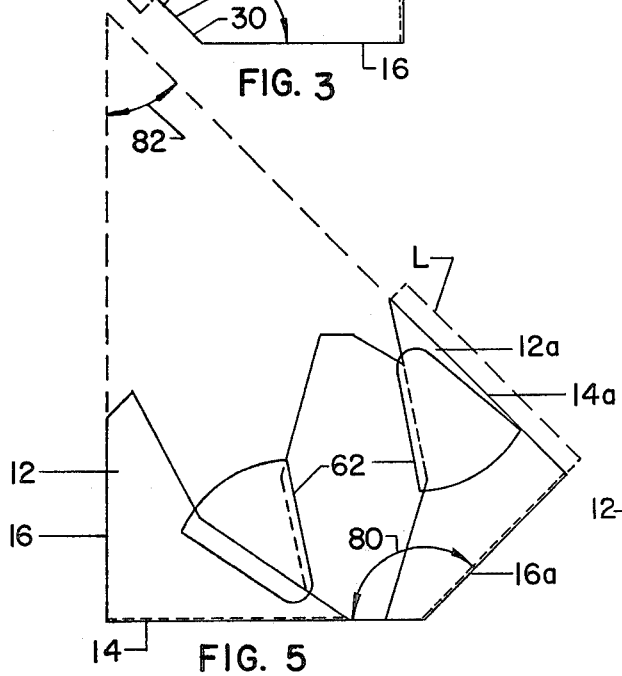
Figure 6:
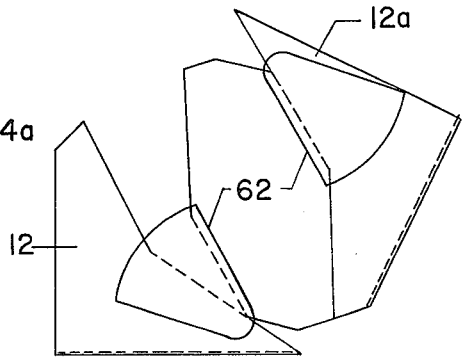

Referring now to FIGS. 5 and 6, the triangular shaped plates 12 and 12*a* are illustrated as being bodily moved so that the edge 14 of template 12 bears against the upper edge e of the T-square T. In this position, a draftsman could place the lettering set L along the edge 14*a* of template 12*a*. In the position of the parts illustrated in FIG. 5, the included angle 80 between the edge 16*a* of template 12*a* and the edge 14 of template 12 is an obtuse angle whereas the included angle 82 between the edge 16 of template 12 and the edge 14*a* of template 12*a* is an acute angle.

It is to be understood that the drawings and descriptive matter are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. A drafting instrument comprising:

a central, generally planar member;

first and second drafting plates, each including two sides having first and second angularly related, intersecting straight edges forming an angle therebetween and third hypotenuse edge means spanning said first and second edges; and means pivotally coupling said first and second plates to said central planar member for swinging movement relative thereto; said central member including first and second ends and laterally opposite sides, each of said sides including outwardly converging, opposite end edge portions spanned by a central edge portion, said third hypotenuse edge means including inner edge portions complemental to said central edge portion and one of said opposite and edge portions.

2. The instrument set forth in claim 1 including protractor means on one of said central member and said first and second plates for measuring the angular relationship between said first and second edges of said first and secon plates.

3. The instrument set forth in claim 2 wherein said protractor means is mounted on said central member and includes a pair of arcuate slots on opposite sides of said central member, and guide means, mounted on said first and second plates, received by said slots for guiding the swinging movement of said plates.

4. The instrument set forth in claim 3 including means for releasably securing said plates to said central member in any selected one of a plurality of relative positions to selectively inhibit relative movement.

5. The instrument set forth in claim 1 wherein said coupling means is coupled to said first and second plates such that said third edge means are disposed in confronting relation with laterally opposite sides of said planar member.

6. The instrument set forth in claim 1 wherein said coupling means mounts said first and second drafting plates on said central member for movement between any one of a plurality of different positions in which the included angle between said first edge of one of said plates and said second edge of the other of said plates is selectively either an acute angle or an obtuse angle.

7. The instrument set forth in claim 1 wherein said first and second ends include end edges generally transverse to and spanning said opposite end edge portions.

8. The instrument set forth in claim 7 wherein said coupling means mounts said first and second plates on said central member for swinging movement in opposite directions between closed positions in which said inner edge portions abut said central edge portions and said one of said opposite end edge portions, and open positions in which said inner edge portions are removed from said central edge portions and said one of said opposite end edge portions; said plates and said central member being so positioned that said first edges lie in the planes of said end edges when said plates are in said open positions.

9. The instrument set forth in claim 8 wherein a portion of said third edge means of each of said plates lies in the planes of said opposite end edges when said plates are in said closed positions.

10. The instrument set forth in claim 1 wherein said coupling means permits relative movement of said first and second plates and said central member between any one of a plurality of different positions in which said second edges are disposed in parallel relation at any selected one of a plurality of differing spaced apart locations.

11. A drafting instrument comprising:

first and second, generally planar, substantially identical drafting plates each including first and second right angularly related edges spanned by hypotenuse edge means;

a central, generally planar mounting member having laterally opposite sides disposed in confronting relation with at least portions of said hypotenuse edge means of said first and second drafting plates; said laterally opposite sides and said portions of said hypotenuse edge means having complementally confronting contours; means for coupling said plates to said mounting member for movement between any one of a plurality of different spaced apart positions in which the corresponding edges of said drafting plates remain parallel, as well as for swinging movement between any one of a plurality of different positions in which the included angle between said second edge of one of said plates and said first edge of the other of said plates is selectively less than 90° and more than 90°.

12. A drafting instrument including:

a central, generally planar, mounting member including laterally opposite side edges, generally parallel end edges spanning the terminal ends of said side edges;

a pair of drafting plates, each including a triangular portion and a truncated triangle section;

said triangular portion including a first straight edge;

said truncated triangle section including:

a second straight edge disposed perpendicularly to said first straight edge, a third edge converging toward said second edge, and a transversely extending edge spanning said second and third edge; and means mounting said pair of drafting plates on laterally opposite sides of said central mounting member for swinging movement between positions in which said transversely extending edges lie in the planes of said end edges and angularly adjusted positions.

13. The drafting instrument set forth in claim 1 wherein said drafting plates are movable between positions in which said first edge of one of said plates lies in the plane of said transversely extending edge of the other of said plates and one of said end edges.

14. A drafting instrument comprising:

a central, generally planar member having laterally opposite sides;

first and second drafting plates, each including two sides having first and second right angularly related, intersecting straight edges and third hypotenuse edge means spanning said first and second edges; portions of said laterally opposite sides and portions of said hypotenuse edge means being complementally shaped and disposed in confronting relation with each other; and means pivotally coupling said first and second plates to said central planar member for swinging movement relative thereto;

said coupling means being coupled to said first and second plates adjacent said third edge means and to laterally opposite sides of said planar member;

said coupling means mounting said first and second plates on said central member for swinging movement in opposite directions between closed positions in which said portions of said hypotenuse edge means abut portions of said lateral edges and open positions in which said portions of said hypotenuse edge means are removed from said portions of said lateral edges.

15. A drafting instrument comprising:

a central mounting plate having laterally opposite sides;

first and second generally similar drafting plates disposed on laterally opposite sides of said central mounting plate; said central mounting plate and said first and second drafting plate lying in the same plane;

each of said drafting plates including first and second right angularly related, intersecting straight edges and third hypotenuse edge means spanning the distal terminal ends of said first and second edges; portions of said hypotenuse edge means being disposed in confronting relation with said laterally opposite sides of said mounting plate; and means mounting said drafting plates on laterally opposite sides of said central mounting plate for movement between positions in which the included angle between said first edge of one plate and said second edge of said second plate is less than 90° and positions in which the said included angle is greater than 90°;

said coupling means comprising an arm lying in a second plane parallel to said first mentioned plane; said arm being fixed to one of said central, generally planar member and said first and second drafting plates and being pivotally coupled to the other of said central, generally planar member and said first and second drafting plates.

* * * * *